US009121397B2

(12) United States Patent
Marica

(10) Patent No.: US 9,121,397 B2
(45) Date of Patent: Sep. 1, 2015

(54) PULSATION DAMPENING SYSTEM FOR A RECIPROCATING PUMP

(75) Inventor: Adrian Marica, Cypress, TX (US)

(73) Assignee: NATIONAL OILWELL VARCO, L.P., Houston, TX (US)

( * ) Notice: Subject to any disclaimer, the term of this patent is extended or adjusted under 35 U.S.C. 154(b) by 1101 days.

(21) Appl. No.: 12/971,757

(22) Filed: Dec. 17, 2010

(65) Prior Publication Data

US 2012/0152360 A1 Jun. 21, 2012

(51) Int. Cl.
*F04B 11/00* (2006.01)
*F04B 17/04* (2006.01)

(52) U.S. Cl.
CPC ..... *F04B 17/048* (2013.01); *F04B 11/00* (2013.01); *Y10T 137/0318* (2015.04); *Y10T 137/86091* (2015.04)

(58) Field of Classification Search
CPC ..... F04B 11/00–11/0033; F04B 39/0066; F04B 39/0088; F04B 39/0027; F16L 55/04; F15B 2201/15; F15B 2201/515
USPC ..... 417/26, 541, 542, 543, 540; 60/415; 138/30, 31
See application file for complete search history.

(56) References Cited

U.S. PATENT DOCUMENTS

| | | | | |
|---|---|---|---|---|
| 1,739,096 | A | | 12/1929 | Seifert |
| 2,204,854 | A | | 6/1940 | Hambly |
| 2,283,207 | A | | 5/1942 | Hollander |
| 2,497,300 | A | | 2/1950 | Elliott |
| 2,673,525 | A | | 3/1954 | Lucas |
| 2,698,576 | A | * | 1/1955 | Strub ..... 417/265 |
| 2,703,055 | A | | 3/1955 | Veth et al. |
| 2,849,026 | A | | 8/1958 | Taplin |

(Continued)

FOREIGN PATENT DOCUMENTS

| | | |
|---|---|---|
| DE | 3923529 A1 | 1/1990 |
| EP | 0264613 A2 | 4/1988 |

(Continued)

OTHER PUBLICATIONS

International Search Report and Written Opinion dated Sep. 12, 2013, for International Application No. PCT/US2011/062800, International File Date Dec. 1, 2011.

(Continued)

*Primary Examiner* — Devon Kramer
*Assistant Examiner* — Nathan Zollinger
(74) *Attorney, Agent, or Firm* — Conley Rose, P.C.

(57) ABSTRACT

A pressure pulsation dampening system for a pump that pressurizes a working fluid. In some embodiments, the dampening system includes a hydraulic cylinder, a valve, and a controller. The hydraulic cylinder has a piston that is movably disposed within a housing and divides the housing into a working fluid chamber and a hydraulic fluid chamber. An outlet of the pump is in fluid communication with the working fluid chamber, and the valve is in fluid communication with the hydraulic fluid chamber. The controller is operable to actuate the valve to a first configuration, wherein pressurized hydraulic fluid is supplied to the hydraulic fluid chamber, and to a second configuration, wherein hydraulic fluid is exhausted from the hydraulic fluid chamber. The piston is movable under fluid pressure, whereby working fluid is relieved from the outlet to the working fluid chamber or supplied to the outlet from the working fluid chamber.

19 Claims, 7 Drawing Sheets

(56) References Cited

U.S. PATENT DOCUMENTS

| | | | | | |
|---|---|---|---|---|---|
| 3,168,045 | A | * | 2/1965 | Sebastiani | 417/383 |
| 3,236,158 | A | | 2/1966 | Taplin | |
| 3,269,276 | A | | 8/1966 | Natanson | |
| 3,283,670 | A | | 11/1966 | Taplin | |
| 3,289,406 | A | | 12/1966 | Panhard | |
| 3,372,624 | A | | 3/1968 | Rietdijk | |
| 3,373,694 | A | | 3/1968 | Taplin | |
| 3,375,759 | A | | 4/1968 | Smith | |
| 3,403,603 | A | | 10/1968 | Turner | |
| 3,619,087 | A | | 11/1971 | Beeman | |
| 3,630,235 | A | * | 12/1971 | Wiley et al. | 138/31 |
| 3,885,583 | A | | 5/1975 | Tennis | |
| 3,934,480 | A | | 1/1976 | Nederlof | |
| 3,969,991 | A | | 7/1976 | Comstock et al. | |
| 3,994,166 | A | | 11/1976 | Dower | |
| 4,242,057 | A | | 12/1980 | Bender | |
| 4,269,569 | A | | 5/1981 | Hoover | |
| 4,297,982 | A | | 11/1981 | Lakra | |
| 4,304,531 | A | | 12/1981 | Fisher | |
| 4,386,888 | A | | 6/1983 | Verley | |
| 4,392,784 | A | | 7/1983 | Hanafi | |
| 4,450,753 | A | | 5/1984 | Basrai et al. | |
| 4,468,174 | A | | 8/1984 | Pryor | |
| 4,470,771 | A | | 9/1984 | Hall et al. | |
| 4,500,267 | A | | 2/1985 | Birdwell | |
| 4,527,959 | A | | 7/1985 | Whiteman | |
| 4,537,562 | A | | 8/1985 | Lindmark et al. | |
| 4,611,633 | A | | 9/1986 | Buchholz et al. | |
| 4,625,364 | A | | 12/1986 | Adams | |
| 4,676,724 | A | | 6/1987 | Birdwell | |
| 4,734,011 | A | | 3/1988 | Hall, Jr. | |
| 4,738,595 | A | | 4/1988 | Gaiser | |
| 4,789,313 | A | | 12/1988 | Tower et al. | |
| 4,880,363 | A | | 11/1989 | Holland | |
| 4,883,409 | A | | 11/1989 | Strohmeier et al. | |
| 4,897,996 | A | | 2/1990 | Hagin et al. | |
| 5,024,584 | A | | 6/1991 | Bordini et al. | |
| 5,074,757 | A | | 12/1991 | Horn | |
| 5,083,430 | A | | 1/1992 | Hirata et al. | |
| 5,249,932 | A | | 10/1993 | Van Bork | |
| 5,337,561 | A | | 8/1994 | Raghavan et al. | |
| 5,348,453 | A | | 9/1994 | Baran et al. | |
| 5,630,709 | A | | 5/1997 | Bar-Cohen | |
| 5,662,461 | A | | 9/1997 | Ono | |
| 5,836,400 | A | | 11/1998 | Tupper et al. | |
| 5,878,647 | A | | 3/1999 | Wilke et al. | |
| 5,974,800 | A | | 11/1999 | Scheidl et al. | |
| 6,068,448 | A | * | 5/2000 | Muratsubaki et al. | 417/44.2 |
| 6,070,408 | A | * | 6/2000 | Clarke et al. | 60/415 |
| 6,234,758 | B1 | * | 5/2001 | Pawelski | 417/26 |
| 6,371,733 | B1 | | 4/2002 | Renfro | |
| 6,454,542 | B1 | | 9/2002 | Back | |
| 6,536,467 | B2 | | 3/2003 | Wu et al. | |
| 6,554,578 | B1 | | 4/2003 | Siegel | |
| 6,623,254 | B2 | | 9/2003 | Chowaniec et al. | |
| 6,767,189 | B2 | | 7/2004 | Kleibrink | |
| 7,252,148 | B2 | | 8/2007 | Traylor | |
| 2002/0071771 | A1 | | 6/2002 | Miller | |
| 2002/0106291 | A1 | | 8/2002 | Young | |
| 2002/0106292 | A1 | | 8/2002 | Chowaniec et al. | |
| 2003/0021700 | A1 | | 1/2003 | Serafin et al. | |
| 2004/0167738 | A1 | | 8/2004 | Miller | |
| 2006/0204375 | A1 | | 9/2006 | Judge et al. | |
| 2006/0228225 | A1 | | 10/2006 | Rogers | |
| 2007/0084357 | A1 | | 4/2007 | Dantlgraber | |
| 2008/0078583 | A1 | | 4/2008 | Cummins | |
| 2008/0170954 | A1 | | 7/2008 | Jiang et al. | |
| 2009/0060687 | A1 | | 3/2009 | White | |

FOREIGN PATENT DOCUMENTS

| | | | |
|---|---|---|---|
| EP | 0362409 | A1 | 4/1990 |
| EP | 0393688 | A2 | 10/1990 |
| EP | 0578390 | A1 | 1/1994 |
| EP | 1944512 | A1 | 7/2008 |
| WO | 01/81761 | A1 | 11/2001 |
| WO | 02090771 | A2 | 11/2002 |
| WO | 2010045064 | A1 | 4/2010 |

OTHER PUBLICATIONS

Canadian Patent Application No. 2,821,913 Office Action dated Jul. 2, 2014 (9 pages).

* cited by examiner

PULSATION DAMPENING SYSTEM FOR A RECIPROCATING PUMP

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND

The disclosure relates generally to systems and methods for reducing pressure pulsations in a reciprocating pump. More particularly, the disclosure relates to a dampening system for reducing pressure pulsations in a fluid discharged by the reciprocating pump.

To form an oil or gas well, a bottom hole assembly (BHA), including a drill bit, is coupled to a length of drill pipe to form a drill string. The drill string is then inserted downhole, where drilling commences. During drilling, drilling fluid, or "drilling mud," is circulated down through the drill string to lubricate and cool the drill bit as well as to provide a vehicle for removal of drill cuttings from the borehole. After exiting the bit, the drilling fluid returns to the surface through the annulus formed between the drill string and the surrounding borehole wall. Instrumentation for taking various downhole measurements and communication devices are commonly mounted within the drill string. Many such instrumentation and communication devices operate by sending and receiving pressure pulses through the annular column of drilling fluid maintained in the borehole.

Mud pumps are commonly used to deliver the drilling fluid to the drill string during drilling operations. Many conventional mud pumps are reciprocating pumps, having a piston-cylinder assembly driven by a crankshaft and hydraulically coupled between a suction manifold and a discharge manifold. Each piston-cylinder assembly has a piston housed within a cylinder. During operation of the mud pump, the piston is driven to reciprocate within the cylinder. As the piston moves to expand the volume within the cylinder, drilling fluid is drawn from the suction manifold into the cylinder. After the piston reverses direction, the volume within the cylinder decreases and the pressure of drilling fluid contained with the cylinder increases. When the piston reaches the end of its stroke, the now-pressurized drilling fluid is exhausted from the cylinder into the discharge manifold. While the mud pump is operational, this cycle repeats, often at a high cyclic rate, and pressurized drilling fluid is continuously fed to the drill string at a substantially constant rate.

Because the piston directly contacts drilling fluid within the cylinder, loads are transmitted from the piston to the drilling fluid. Due to the reciprocating motion of the piston, the transmitted loads are cyclic, resulting in the creation of pressure pulsations in the drilling fluid. There are other sources known to produce and/or affect pulsations in the drilling fluid. These sources include the valves and ports of the mud pump, a discharge strainer positioned in the vicinity of the mud pump, the piston rod itself, depending upon its design, and variations in the drilling fluid, such as variations in its temperature, viscosity, and/or consistency. Regardless of their source, the pressure pulsations disturb the downhole communication devices and instrumentation by degrading the accuracy of measurements taken by the instrumentation and hampering communications between downhole devices and control systems at the surface. Over time, the pressure pulsations may also cause fatigue damage to the drill string pipe and other downhole components.

Accordingly, there is a need for an apparatus or system that reduces pressure pulsations created within fluid pressurized by a reciprocating pump.

SUMMARY

A reciprocating pump having a pressure pulsation dampening system and associated methods of pressure pulsation dampening are disclosed. In some embodiments, the pressure pulsation dampening system includes a hydraulic cylinder, a valve, and a controller. The hydraulic cylinder has a piston that is movably disposed within a housing and divides the housing into a working fluid chamber and a hydraulic fluid chamber. An outlet of the pump is in fluid communication with the working fluid chamber, and the valve is in fluid communication with the hydraulic fluid chamber. The controller is operable to actuate the valve to a first configuration, wherein pressurized hydraulic fluid is supplied to the hydraulic fluid chamber, and to a second configuration, wherein hydraulic fluid is exhausted from the hydraulic fluid chamber. The piston is movable relative to the housing under pressure from working fluid in the working fluid chamber and hydraulic fluid in the hydraulic fluid chamber, whereby working fluid is relieved from the outlet to the working fluid chamber or supplied to the outlet from the working fluid chamber.

In some embodiments, a reciprocating pump system includes a reciprocating pump and a pressure pulsation dampening system. The reciprocating pump has a reciprocating pump with a piston-cylinder assembly operable to pressurize a working fluid and having an outlet. The pressure pulsation dampening system includes a hydraulic cylinder and a valve. The hydraulic cylinder has a piston movably disposed within a housing and dividing the housing into a working fluid chamber and a hydraulic fluid chamber. The working fluid chamber is in fluid communication with the outlet. The valve is in fluid communication with the hydraulic fluid chamber and actuatable to a first configuration, wherein pressurized hydraulic fluid is supplied to the hydraulic fluid chamber, and to a second configuration, wherein hydraulic fluid is exhausted from the hydraulic fluid chamber. The piston is movable relative to the housing under pressure from working fluid in the working fluid chamber and hydraulic fluid in the hydraulic fluid chamber, whereby working fluid is relieved from the outlet to the working fluid chamber or supplied to the outlet from the working fluid chamber.

Some methods for dampening pressure pulsations in a working fluid discharged by a pump include disposing a piston with a housing, the piston dividing the housing into a first chamber and a second chamber and being movable relative to the cylinder; providing fluid communication between an outlet of the pump and the first chamber; pressurizing the second chamber with a hydraulic fluid to a predetermined level; moving the piston in response to a pressure fluctuation at the outlet, whereby the volume of the first chamber changes; and changing the quantity of hydraulic fluid in the second chamber, whereby the pressure of the working fluid in the first chamber returns to the predetermined level.

Thus, embodiments described herein comprise a combination of features and characteristics intended to address various shortcomings associated with conventional reciprocating pumps. The various characteristics described above, as well as other features, will be readily apparent to those skilled in the art upon reading the following detailed description of the preferred embodiments, and by referring to the accompanying drawings.

BRIEF DESCRIPTION OF THE DRAWINGS

For a detailed description of the disclosed embodiments, reference will now be made to the accompanying drawings in which.

DETAILED DESCRIPTION OF THE DISCLOSED EMBODIMENTS

Figure 1:
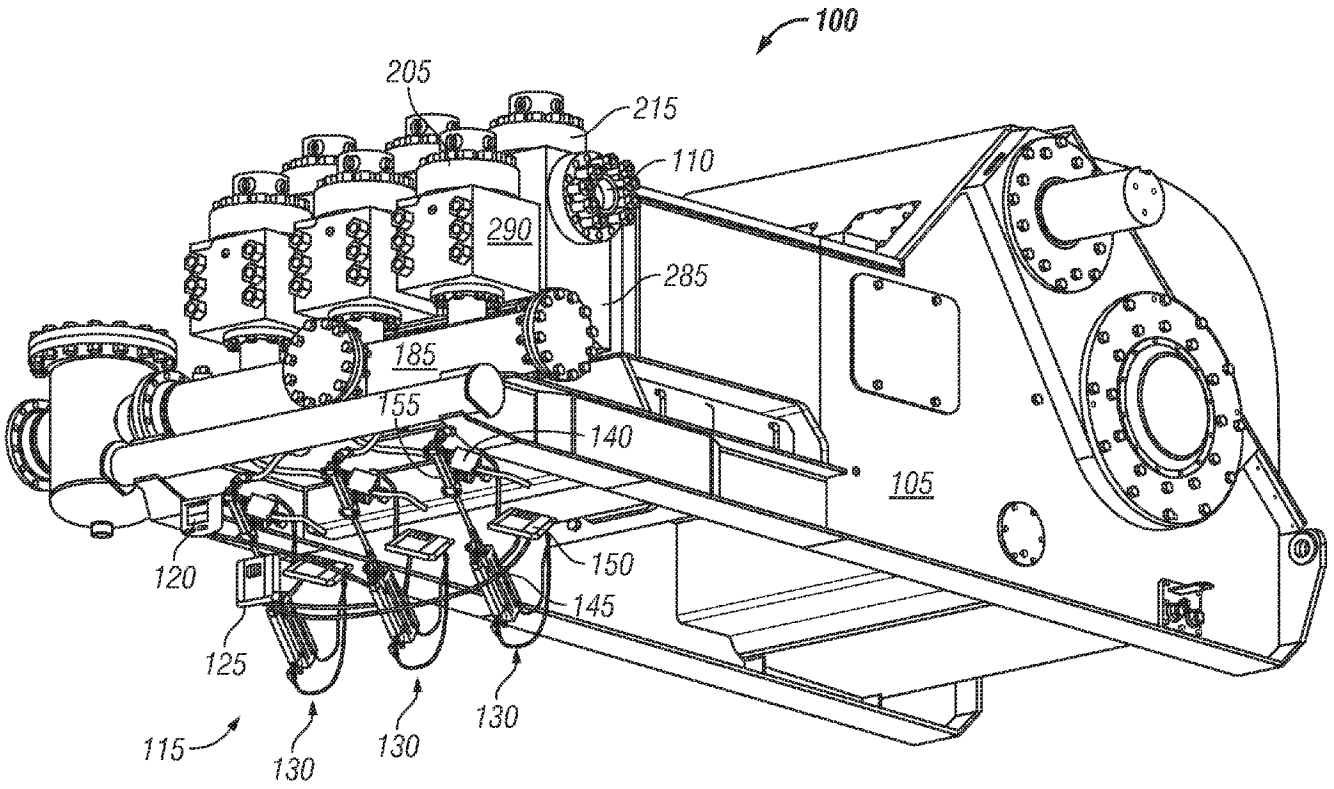
FIG. 1 is a perspective view of a reciprocating pump system including a pressure pulsation dampening system in accordance with the principles disclosed herein.

The following description is directed to exemplary embodiments of a reciprocating pump with an pulsation dampening system. The embodiments disclosed should not be interpreted, or otherwise used, as limiting the scope of the disclosure, including the claims. One skilled in the art will understand that the following description has broad application, and that the discussion is meant only to be exemplary of the described embodiments, and not intended to suggest that the scope of the disclosure, including the claims, is limited only to those embodiments.

Certain terms are used throughout the following description and the claims to refer to particular features or components. As one skilled in the art will appreciate, different persons may refer to the same feature or component by different names. This document does not intend to distinguish between components or features that differ in name but not function. Moreover, the drawing figures are not necessarily to scale. Certain features and components described herein may be shown exaggerated in scale or in somewhat schematic form, and some details of conventional elements may not be shown in interest of clarity and conciseness.

In the following discussion and in the claims, the terms "including" and "comprising" are used in an open-ended fashion, and thus should be interpreted to mean "including, but not limited to . . . . " Also, the term "couple" or "couples" is intended to mean either an indirect or direct connection. Thus, if a first device couples to a second device, the connection between the first device and the second device may be through a direct connection, or through an indirect connection via other intermediate devices and connections. Further, the terms "axial" and "axially" generally mean along or parallel to a particular axis.

Referring now to FIG. 1, there is shown a reciprocating pump system 100 including a reciprocating pump 105, a discharge manifold 110, a suction manifold 185, and a pressure pulsation dampening system 115. Reciprocating pump 105 is operable to pressurize a working fluid, such as but not limited to drilling mud, to a desired pressure. As will be described, the working fluid is drawn from the suction manifold 185 into the pump 105, pressurized by the pump 105, and discharged into the discharge manifold 110. In the illustrated embodiment, the reciprocating pump 105 is a conventional triplex reciprocating pump, having three piston-cylinder assemblies (not visible in FIG. 1) driven out of phase with each other by a common crankshaft (also not visible).

The pressure pulsation dampening system 115 is operable to reduce pressure pulsations created in the working fluid upstream of the discharge manifold 110. For the triplex pump 105 shown in FIG. 1, the pressure pulsation dampening system 115 includes a monitor 120, a system control unit 125, and three piston-cylinder dampening systems 130. Each piston-cylinder dampening system 130 is coupled to a different piston-cylinder assembly of the pump 105 and configured to reduce pressure pulsations in pressurized fluid exhausted by that piston-cylinder assembly. Each piston-cylinder dampening system 130 includes a valve 140, a dampener 145, a local control unit 150, and a hydraulic cylinder 155.

Figure 2:
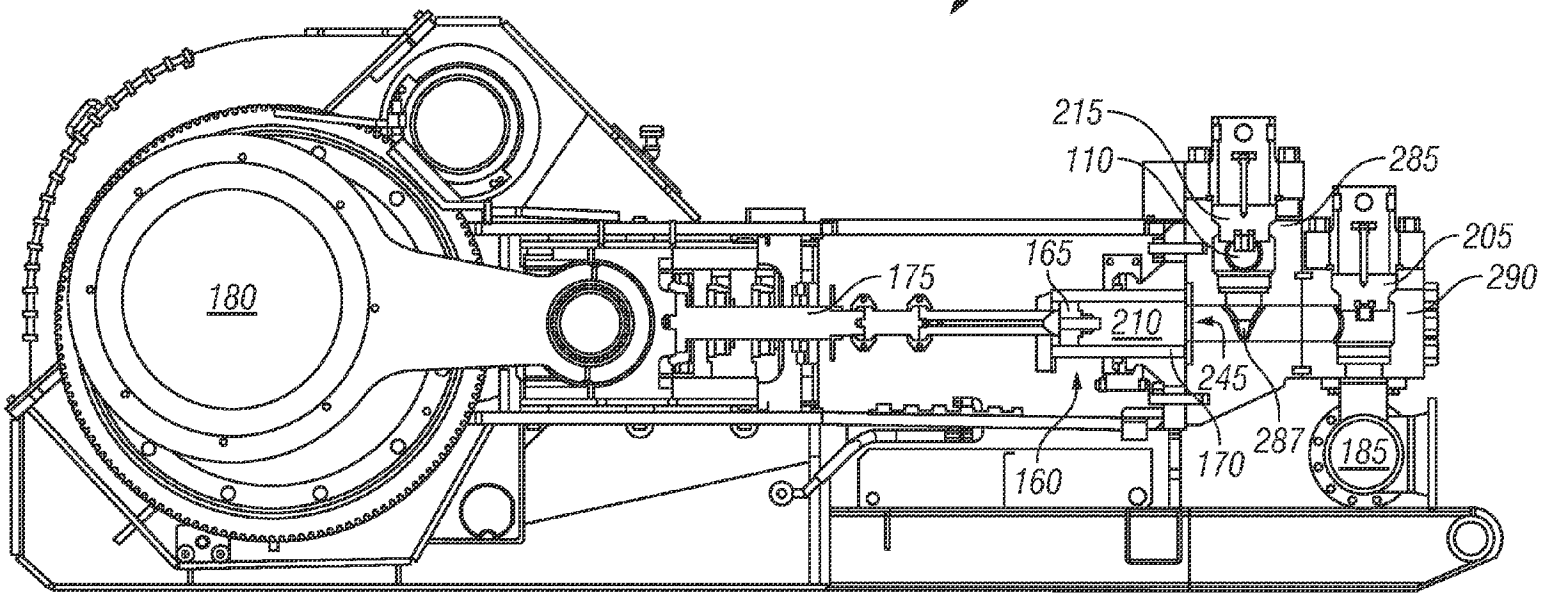
FIG. 2 is a lengthwise, cross-sectional view of the reciprocating pump of FIG. 1.

Referring next to FIG. 2, the pump 105 includes three piston-cylinder assemblies 160, each coupled to a piston-cylinder dampening system 130 (FIG. 1). Only one piston-cylinder assembly 160 is visible in FIG. 2. The following description of the piston-cylinder assembly 160 shown in FIG. 2 and its associated dampening system 130 also describes to the other piston-cylinder assemblies 160, which are not visible in FIG. 2, and their associated dampening systems 130.

The piston-cylinder assembly 160 is coupled to a discharge valve block 285 through which the discharge manifold 110 extends. A discharge valve 215 is disposed within the discharge valve block 285. The discharge valve block 285 is coupled to a suction valve block 290, which is, in turn, coupled to the suction manifold 185. A suction valve 205 is disposed in the suction valve block 285. The discharge valve block 285 includes an internal throughbore, or chamber, 287 that enables fluid communication between the suction valve 205 and the piston-cylinder assembly 160, and between the piston-cylinder assembly 160 and the discharge valve 215.

The piston-cylinder assembly 160 includes a piston 165 movably disposed within a cylinder 170. The piston 165 is coupled by a rod 175 to a rotatable crankshaft 180. As the crankshaft 180 rotates, the piston 165 is caused to move, or reciprocate, within the cylinder 170.

Figure 3:
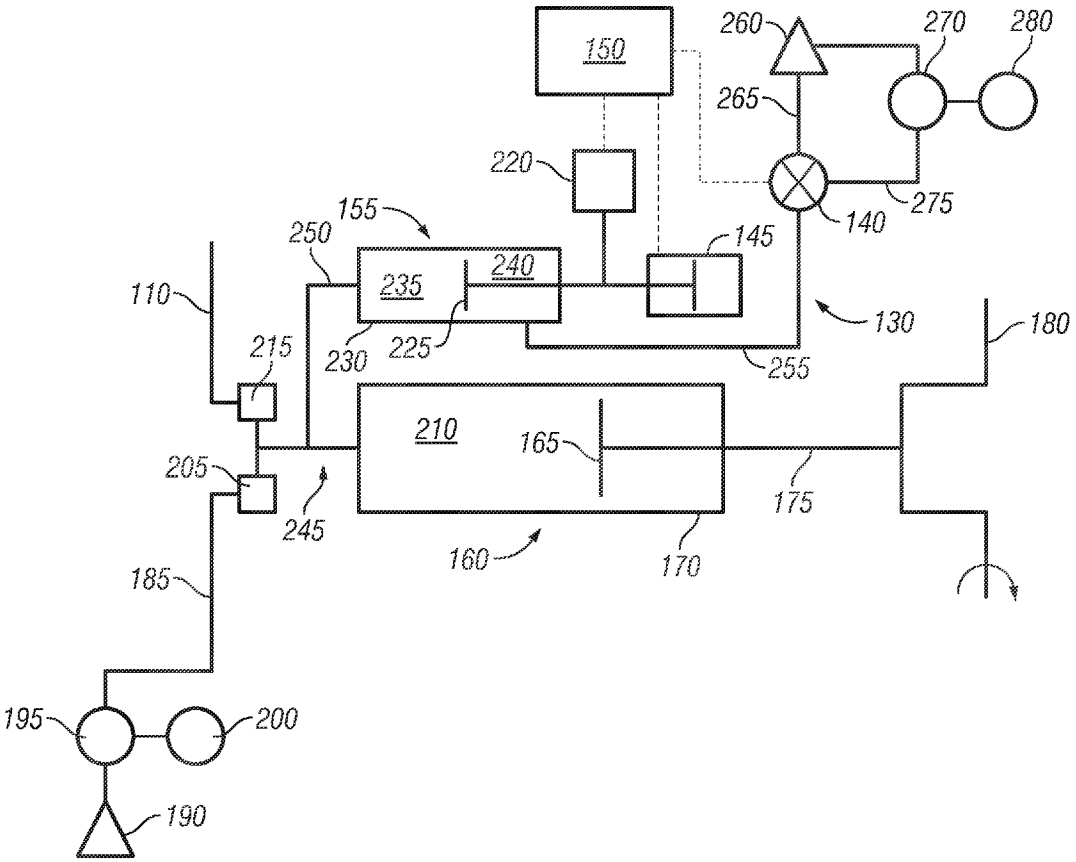
FIG. 3 is a schematic representation of one piston-cylinder assembly of the reciprocating pump of FIG. 1 and its associated dampening system.

FIG. 3 is a schematic representation of the piston-cylinder assembly 160 and its associated dampening system 130. Referring now to FIGS. 2 and 3, drilling mud is delivered from a source 190 via a pump 195 driven by a motor 200 to the suction manifold 185. As the piston 165 is stroked back by the crankshaft 180 (FIG. 2), the discharge valve 215 is closed, and drilling mud is drawn from the suction manifold 185 through the suction valve 205 and the throughbore 287 into a compression chamber 210 within the cylinder 170. After the piston 165 reverses direction, the suction valve 205 is closed, and drilling mud contained within the compression chamber 210 is exhausted from the cylinder 170 through the throughbore 287 and the discharge valve 215 into the discharge manifold 110 as the piston 165 strokes out or forward. As the crankshaft 180 rotates, the piston-cylinder 160 repeatedly draws in drilling mud from the suction manifold 185, pressurizes the drilling mud received, and exhausts the pressurized drilling mud into the discharge manifold 110.

Figure 4:
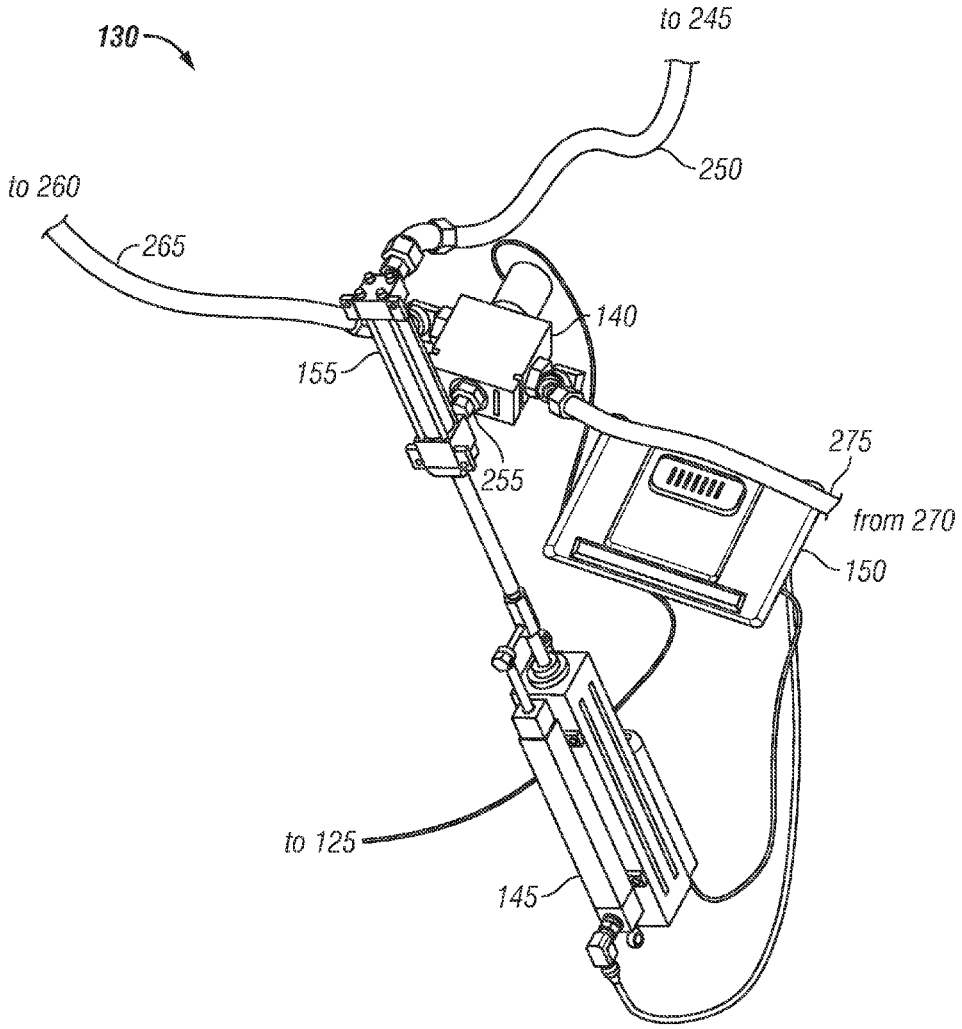
FIG. 4 is an enlarged perspective view of the pressure pulsation dampening system of FIG. 1.

The piston-cylinder dampening system 130 reduces pressure pulsations created in the drilling mud exhausted by the cylinder 170 of the piston-cylinder assembly 160. Referring briefly to FIG. 4, the pulsation dampening system 130 includes the hydraulic cylinder 155, the dampener 145, the valve 140, a transducer 220 (FIG. 3 only), and the local control unit 150. Returning to FIG. 3, the hydraulic cylinder 155 includes a piston 225 movably disposed within a housing 230. The piston 225 sealingly engages the inner surface of the housing 230, thereby dividing the internal volume of the housing 230 into two chambers 235, 240.

Chamber 235 is fluidicly coupled to, meaning in fluid communication with, an outlet 245 of the piston-cylinder assembly 160. Drilling mud exhausted by the piston-cylinder assembly 160 is free to flow between the outlet 245 and the chamber 235 in either direction, depending the difference in pressure of the drilling mud at the outlet 245 and in the chamber 235. In some embodiments, as discussed below and illustrated by FIGS. 5A and 5B, the chamber 235 is fluidicly coupled to the outlet 245 by a flowline 250 (see also FIG. 4) coupled between the hydraulic cylinder 155 (FIG. 4) and an angled channel 300 extending through the discharge valve block 285 (FIGS. 5A, 5B).

Figure 5A:
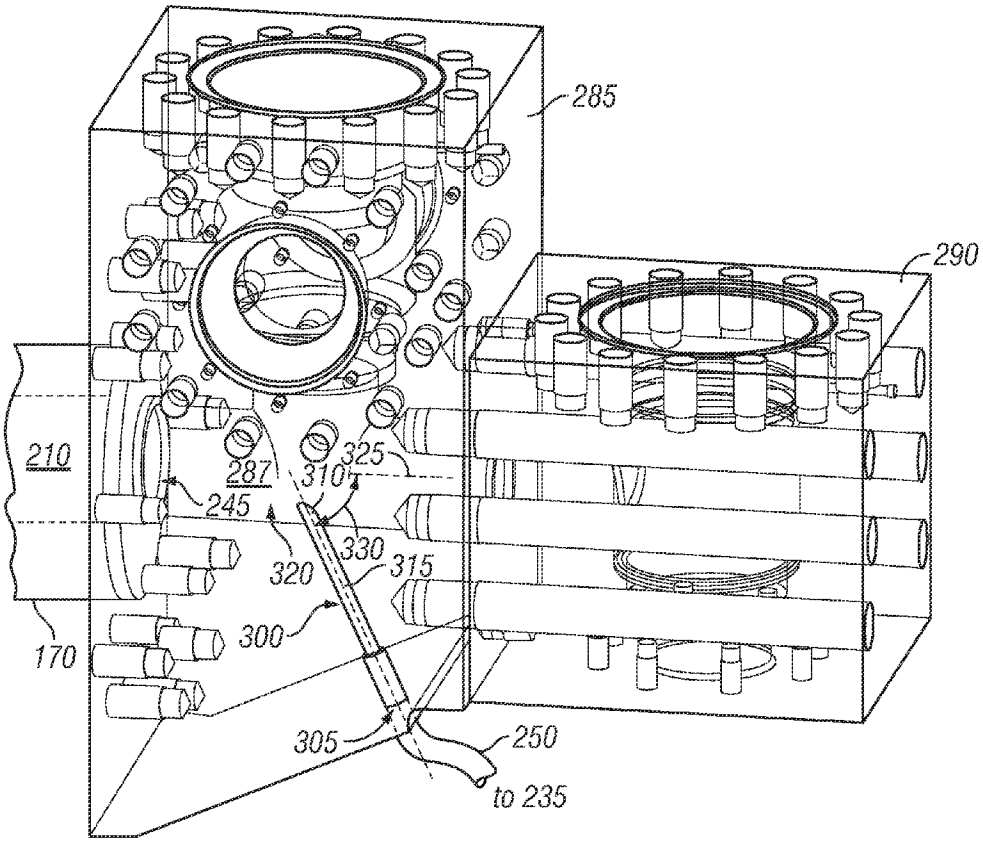
FIGS. 5A and 5B are perspective side views of a discharge valve block of the reciprocating pump of FIG. 1, illustrating an angled channel in the discharge valve block providing fluid communication between the piston-cylinder assembly and the hydraulic cylinder of the associated piston-cylinder dampening system.
Figure 5B:
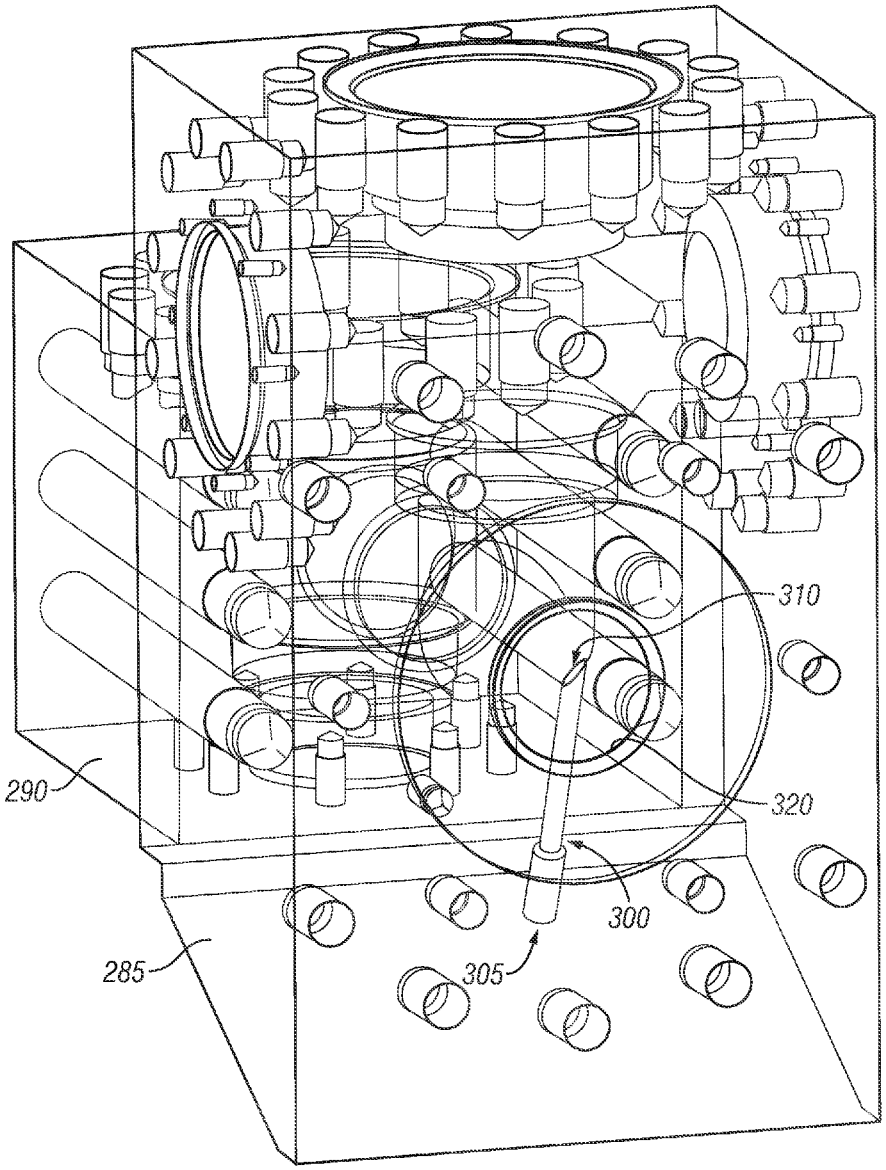

As best seen in FIGS. 5A and 5B, angled channel 300 has an external port 305 and an internal port 310. Angled channel 300 intersects with a surface 320 of the discharge valve block 285 that defines, or bounds, throughbore 287 to form the internal port 310. Thus, the internal port 310 is aligned, or flush, with surface 320. Further, the internal port 310 is in fluid communication with the throughbore 287 and with the outlet 245 via throughbore 287. The angled channel 300 intersects an outer surface 283 of the discharge valve block 285 to form the external port 305. Thus, the external port 305 is flush with surface 283. Further, the flowline 250 of the piston-cylinder dampening system 130 is coupled to the discharge valve block 285 over the external port 305 such that fluid communication is established between the angled channel 300 and the chamber 235.

Figure 6:
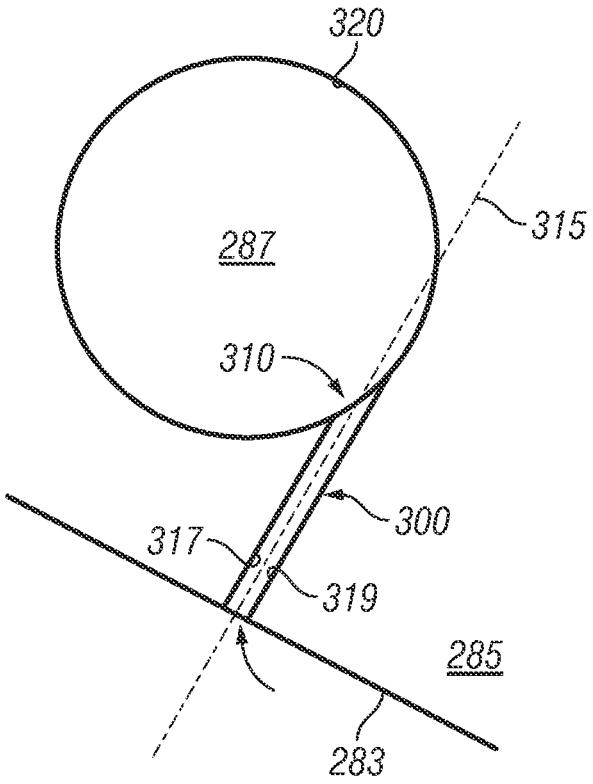
FIG. 6 is a schematic representation of the angled channel of FIGS. 5A and 5B.

FIG. 6 is a schematic representation of a cross-sectional view through the discharge valve block 285 and throughbore 287, and bisecting the angled channel 300 to illustrate the orientation of the angled channel 300 relative to throughbore 287. As shown, the angled channel 300 further includes a longitudinal centerline 315, an inner edge 317, and an outer edge 319. The angled channel 300 is oriented relative to throughbore 287 such that outer edge 319 is tangent to surface 320 bounding throughbore 287. Also, the angled channel 300 is oriented relative to the discharge valve block 285 such that centerline 315 is substantially normal to outer surface 283 of the discharge valve block 285.

The orientation of the angled channel 300 relative to throughbore 287 prevents the creation of turbulence in drilling mud passing through throughbore 287 that may otherwise occur if the intersection of the angled channel 300 with throughbore 287 created a discontinuity in surface 320. Moreover, due to the orientation of the angled channel 300 relative to throughbore 287, drilling mud entering throughbore 287 from the angled channel 300 is conveyed adjacent surface 320 in a swirling pattern along throughbore 287 and gradually mixed with drilling mud already disposed within throughbore 287. This too prevents the creation of turbulence in drilling mud passing through throughbore 287 that may otherwise occur if the two fluid streams were mixed in a more abrupt manner.

Referring again to FIG. 3, chamber 240 is fluidicly coupled to the valve 140 by a flowline or connector 255 (see also FIG. 4). Valve 140, in turn, is fluidicly coupled to a hydraulic fluid reservoir 260 via a flowline 265 (see also FIG. 4) and to a hydraulic fluid source 270 via a flowline 275 (see also FIG. 4). In the illustrated embodiment, the hydraulic fluid source 270 is a pump driven by a motor 280 that receives and pressurizes hydraulic fluid from the reservoir 260. Also, the valve 140 is an electro-proportional reducing/relieving pressure control valve, such as one having model number EHPR98-T38 and manufactured by HydraForce, Inc., headquartered at 500 Barclay Blvd., Lincolnshire, Ill. 60069. In some embodiments, the hydraulic cylinder 155 is manufactured by Parker Hannifin, headquartered at 6035 Parkland Blvd., Cleveland, Ohio 44124 and may have model number 3.25BB2HKPS14AC24.5.

The valve 140 is also electrically coupled to the local control unit 150. As will be described, the valve 140 is actuatable by the local control unit 150 to enable supply of pressurized hydraulic fluid from the source 270 to the chamber 240 and to enable release of hydraulic fluid from the chamber 240 to the reservoir 260. Sealing engagement between the piston 225 and the cylinder 230 enables the chambers 235, 240 to remain fluidicly isolated from each other, meaning there is no fluid communication between the chambers 235, 240. This prevents leakage of pressurized drilling mud into the hydraulic fluid chamber 240, and of pressurized hydraulic fluid into the drilling mud chamber 235.

Depending on pressure differences between drilling mud in the chamber 235 and hydraulic fluid in the chamber 240, the piston 225 moves under fluid pressure relative to the cylinder 230 either to reduce or increase the volume of the chamber 235. When the hydraulic fluid pressure in chamber 240 exceeds the drilling mud pressure in chamber 235, the piston 225 moves to reduce the volume of the chamber 235. As the volume of the chamber 235 is reduced, some quantity of the drilling mud in chamber 235 is exhausted from the chamber 235 through the flowline 250 to the outlet 245 of the piston-cylinder assembly 160, thereby increasing the volume of drilling mud exhausted to the discharge manifold 110.

When the drilling mud pressure in chamber 235 exceeds the hydraulic fluid pressure in chamber 240, the piston 225 moves to increase the volume of the chamber 235. As the volume of the chamber 235 is increased, drilling mud is relieved from the outlet 245 of the piston-cylinder assembly 160 through the flowline 250 into the chamber 235, thereby decreasing the volume of drilling mud exhausted to the discharge manifold 110. In either scenario, the piston 225 ceases to move when the forces exerted on the piston 225 by hydraulic fluid in chamber 240 and by drilling mud in chamber 235 equalize.

For reasons previously described, it is sometimes desirable to reduce, and if possible eliminate, pressure pulsations in fluid exhausted by reciprocating pumps. In other words, it is desirable to provide fluid from the pump with a constant pressure. As suggested above, this is achieved by piston-cylinder dampening system 130 through control of the position of the piston 225.

The valve 140, transducer 220, and local control unit 150 enable control of the position of the piston 225. The transducer 220 is mechanically coupled to the piston 225 and electrically coupled to the local control unit 150. The transducer 220 is configured to sense the position, or a change in the position, of the piston 225 and transmit a signal representative of that position, or change, to the local control unit 150. In some embodiments, the transducer 220 is one having model number TIM 0200 302 821 201 and manufactured by Novotechnik U.S., Inc., headquartered at 155 Northboro Road, Southborough, Mass. 01772, or one having model number GT2S 200M D60 1A0 and manufactured by MTS Systems Corporation, headquartered at 14000 Technology Drive, Eden Prairie, Minn. 55344. Either is suitable for use in the embodiment of FIGS. 1-3. Alternatively, in other embodiments, the transducer 220 may be replaced with a displacement sensor coupled between the local control unit 150 and the hydraulic cylinder 230. Like the transducer 220, the displacement sensor would provide signals to the local control unit 150 that enable the local control unit 150 to determine the position, or the change in position, of the piston 225. In some embodiments, the local control units 150 are manufactured by High Country Tek, Inc., headquartered at 208 Gold Flat Court, Nevada City, Calif. 95959 and may have model number DVC 10.

Using the signal provided by transducer 220, the local control unit 150 determines the volume of hydraulic fluid that must be added to, or relieved from, the chamber 240 to enable the pressure of drilling mud in the chamber 235, and therefore the pressure of drilling mud exhausted to the discharge manifold 110, to remain at a predetermined level. In preferred embodiments, the predetermined level coincides with the desired discharge pressure of the reciprocating pump system 100.

When the local control unit 150 determines that the piston 225 is moving to increase the volume of chamber 235 in response to a pressure spike, or increase, in the drilling mud at the outlet 245 and that hydraulic fluid should be relieved from the chamber 240 to reduce the pressure of drilling mud in chamber 235, the local control unit 150 delivers a signal to the valve 140, causing the valve 140 to open and allow the flow of hydraulic fluid from the chamber 240 through the valve 140 to the reservoir 260. The local control unit 150 has an internally stored algorithm, or ramping strategy, that enables control of the rate at which hydraulic fluid passes through the valve 140 from the chamber 240. As pressurized hydraulic fluid is relieved from the chamber 240, the piston 225 moves to increase the volume of chamber 235 and reduce the pressure of drilling mud therein. When the local control unit 150 determines that a volume of hydraulic fluid has been relieved from chamber 240 sufficient to return the pressure of drilling mud in chamber 235 to the predetermined level, the local control unit 150 actuates the valve 140 to close and interrupt the release of hydraulic fluid from the chamber 240. The control unit 150 determines the volume of hydraulic fluid relieved from chamber 240 using the position, or change in position, of the piston 225, which is, in turn, determined by signals from the transducer 220.

Alternatively, when the local control unit 150 determines the piston 225 is moving to decrease the volume of chamber 235 in response to a drop in drilling mud pressure at the outlet 245 and that pressurized hydraulic fluid should be added to the chamber 240 to increase the pressure of drilling mud in the chamber 235, the local control unit 150 delivers a signal to the valve 140, causing the valve 140 to actuate and open to allow the flow of pressurized hydraulic fluid from the source 270 through the valve 140 into the chamber 240. The local control unit 150 controls the rate at which hydraulic fluid passes through the valve 140 in accordance with the ramping strategy stored therein. As pressurized hydraulic fluid is added to the chamber 240, the piston 225 moves in response to reduce the volume of chamber 235 and increase the pressure of drilling mud therein. When the local control unit 150 determines that a volume of hydraulic fluid has been added to chamber 240 sufficient to return the pressure of drilling mud in chamber 235 to the predetermined level, the local control unit 150 actuates to close the valve 140 to interrupt the supply of hydraulic fluid to the chamber 240. The control unit 150 determines the volume of hydraulic fluid added to chamber 240 using the position, or change in position, of the piston 225, which is, in turn, determined by signals from the transducer 220.

In some embodiments, the ramping strategy of the local control unit 150 is dependent upon the desired discharge pressure $P_{des}$ of the piston-cylinder 160, an assumed bandwidth, and the design configuration of the valve 140. It is desirable that piston-cylinder damping system 130 is operable to maintain the discharge pressure of the piston-cylinder 160 at a substantially constant level corresponding to $P_{des}$ within an acceptable bandwidth. Assuming, for example, a bandwidth of 6%, it is desirable that piston-cylinder damping system 130 functions to maintain the discharge pressure of the piston-cylinder 160 within ±3% of $P_{des}$.

Depending upon the actual discharge pressure $P_{act}$ of the piston-cylinder 160, the control unit 150 opens the valve 140 to varying degrees to deliver hydraulic fluid at the desired rate from or to chamber 240, as needed. The degree to which the valve 140 is opened is dependent upon a pressure difference $\epsilon$, defined as:

$$P_{act}-1.03*P_{des} \text{ when } P_{act} \text{ is greater than } 1.03*P_{des}$$

$$\epsilon=0.97*P_{des}-P_{act} \text{ when } P_{act} \text{ is less than } 0.97*P_{des}$$

$$0 \text{ when } 0.97*P_{des}\leq P_{act}\leq 1.03*P_{des}$$

The greater the pressure difference $\epsilon$, the more the valve 140 is opened to enable a greater flow rate of hydraulic fluid therethrough to quickly return the actual discharge pressure $P_{act}$ to the desired level $P_{des}$. Conversely, the smaller the pressure difference $\epsilon$, the less the valve 140 is opened to enable a lower flow rate of hydraulic fluid through the valve 140 to slowly return the actual discharge pressure $P_{act}$ to the desired level $P_{des}$. When the actual discharge pressure $P_{act}$ is within an acceptable range of $P_{des}$, meaning within ±3% of $P_{des}$, the pressure difference $\epsilon$ is zero, and the valve 140 is not opened.

As previously mentioned, the valve 140 is opened via a signal from the control unit 150, in particular an applied voltage V. Through testing of the valve 140, a correlation between an applied voltage V and the degree to which the valve 140 is opened in response to the applied the voltage V is developed. Likewise, through testing of the piston-cylinder damping system 130, a relationship between the pressure difference $\epsilon$ and voltage V is developed. Using these relationships, the pressure difference $\epsilon$, calculated with the equation shown above, is associated with a valve position that enables the desired flow rate of hydraulic fluid through the valve 140. Such relationships and the above-define equation for pressure difference $\epsilon$ are included within the ramping strategy.

When a pressure spike or decrease occurs in the drilling mud at outlet 245, the pressure difference $\epsilon$ between $P_{act}$ and $P_{des}$ is determined by the control unit 150 using the ramping strategy. Next, the ramping strategy converts the pressure difference $\epsilon$ into a voltage V. The voltage V is then applied to the valve 140 by the control unit 150 to open the valve 140 to the desired degree. Hydraulic fluid flows through the valve 140 at the desired rate to return the actual discharge pressure $P_{act}$ to the desired level $P_{des}$.

As described, the position of the piston 225 is controlled by the addition of hydraulic fluid to and the relief of hydraulic from the chamber 240. Control of the position of the piston 225, in turn, enables control of the pressure of drilling mud in the chamber 235 and therefore the pressure of drilling mud exhausted to the discharge manifold 110 at the preselected level. In the event that a pressure pulsation is created in the drilling mud exhausted by the piston-cylinder assembly 160, the pulsation dampening system 130 responds to increase or decrease the drilling mud pressure as needed to maintain the drilling mud pressure at the predetermined level. Due to the ramping strategy of the local control unit 150, the response of the pulsation dampening system 130 occurs with some amount of delay. Consequently, the pulsation dampening system 130 is capable of responding to pressure pulsations of a certain frequency.

The dampener 145 prevents resonance of the piston 225 at that frequency. The dampener 145 is coupled to the piston 225 and electrically coupled to the local control unit 150. The local control unit 150 actuates the dampener 145 in accordance with at least one internally stored ramping strategy to apply a constant resistive force to the piston 225 when the piston 225 moves. The applied resistance slows movement of the piston 225 so that the piston 225 does not enter into resonance. In preferred embodiments, the dampener 145 is a magneto rheological fluid powered dampener, such as but not limited to model number ERF50 manufactured by Bansbach Easylift GmbH, headquartered at Barbarossastr.8, D-73547 Lorch, Germany. However, any type of dampener that enables the application of a known, controlled, and constant resistance to the movement of the piston 225 may be used.

In contrast to the dampening system 130, many conventional dampening systems do not respond to pressure pulsations in a predictable manner because their response is affected by factors like temperature change or friction. For example, some dampening systems include an expandable bladder filled with a gas, e.g. nitrogen, under pressure. The behavior of the gas is temperature dependent. Moreover, the behavior of the bladder is dependent upon and affected by variations in its material properties. As a result, response of the bladder during expansion or contraction is not predictable or entirely controlled.

As described above, the pulsation dampening system 130 associated with each piston-cylinder assembly 160 enables control and maintenance of the pressure of drilling mud provided by the piston-cylinder 160 to the discharge manifold 110. Each local control unit 150 enables control only of the pressure of drilling mud exhausted by its associated piston-cylinder 160, and exerts no influence on the other piston-cylinders 160, or their dampening systems 130. Thus, control units 150 enable only localized dampening control.

Referring again to FIG. 1, system control unit 125 is operable to modify the performance of each dampening system 130. As such, control unit 125 enables system-wide control of pressure pulsation dampening for reciprocating pump 105. System control unit 125 is coupled to each of the control units 150 and to monitor 120. System control unit 125 includes at least one internally stored algorithm that, when executed using input provided to the control unit 125, generates an output signal. The output signal is then provided as input to at least one of local control units 150 for the purpose of modifying or adjusting the performance of the associated dampening system 130.

For example, signals from a pressure sensor positioned downstream of reciprocating pump system 100 may be provided as input to system control unit 125. Control unit 125, in turn, may use the signals as input to an internally stored algorithm that when executed, determines whether and how the performance of one or more dampening systems 130 should be modified and then provides the necessary input to the appropriate control unit(s) 150. In response to input from system control unit 125, the affected local control unit(s) 150 modifies the performance of the associated dampening system(s) 130. In this manner, system control unit 125 may adjust the performance of any or all of dampening systems 130 based on input provided by instrumentation external to the dampening systems 130.

The monitor 120 displays data relevant to the performance of the reciprocating pump system 100. In some embodiments, the monitor 120 displays system parameters used as input to the system control unit 125 and parameters relevant to the operation and/or performance of each dampening system 130, such as but not limited to the discharge pressure of each piston-cylinder assembly 160, the resistance exerted by each dampener 145, and the flow rate of hydraulic fluid through each valve 140. In some embodiments, the system control unit 125 and the monitor 120 are model numbers DVC10 and DVC61, respectively, manufactured by High Country Tek, Inc., headquartered in Nevada City, Calif.

Pressure pulsation dampening system 115 enables dampening of pressure fluctuations in the drilling mud discharged by the reciprocating pump 105. Modifications to the ramping strategies of the control units 125, 150 enable application of the dampening system 115 to a wide range of reciprocating pumps. Moreover, modifications to the ramping strategies also enable the dampening system 115 to accommodate changes to the reciprocating pump 105, such as its discharge pressure. As such, pulsation dampening system 115 may be incorporated with a new reciprocating pump prior to delivery to the field, or installed on an existing pump already in operation in the field.

While various embodiments have been shown and described, modifications thereof can be made by one skilled in the art without departing from the spirit and teachings herein. The embodiments herein are exemplary only, and are not limiting. Many variations and modifications of the apparatus disclosed herein are possible and within the scope of the invention. Accordingly, the scope of protection is not limited by the description set out above, but is only limited by the claims which follow, that scope including all equivalents of the subject matter of the claims.

What is claimed is:

1. A pressure pulsation dampening system for a reciprocating pump that pressurizes a working fluid delivered from a working fluid source, the pressure pulsation dampening system comprising:

a hydraulic cylinder having a piston movably disposed within a housing and dividing the housing into a working fluid chamber and a hydraulic fluid chamber, wherein the working fluid chamber is in fluid communication with an outlet of the reciprocating pump;

a valve in fluid communication with the hydraulic fluid chamber, the valve actuatable to a first configuration, wherein pressurized hydraulic fluid is supplied to the hydraulic fluid chamber from a hydraulic fluid reservoir that is separate from the working fluid source, and to a second configuration, wherein hydraulic fluid is relieved from the hydraulic fluid chamber; and a controller configured to actuate the valve to the first configuration in response to a pressure decrease at the outlet and to the second configuration in response to a pressure increase at the outlet;

wherein the piston is movable relative to the housing under pressure from working fluid in the working fluid chamber and hydraulic fluid in the hydraulic fluid chamber, whereby working fluid is relieved from the outlet to the working fluid chamber and supplied to the outlet from the working fluid chamber.

2. The pressure pulsation dampening system of claim 1, wherein the pressure of the working fluid at the outlet is a discharge pressure of the reciprocating pump, the discharge pressure being adjustable by the flow of working fluid between the outlet and the working fluid chamber.

3. The pressure pulsation dampening system of claim 2, wherein the controller is configured to actuate the valve such that the discharge pressure is maintained within a preselected bandwidth.

4. The pressure pulsation dampening system of claim 1, further comprising a dampener coupled to the piston, the dampener configured to apply a resistive force that resists movement of the piston when hydraulic fluid is supplied and relieved from the hydraulic fluid chamber.

5. The pressure pulsation dampening system of claim 4, wherein the controller is configured to control the resistive force applied by the dampener to the piston.

6. The pressure pulsation dampening system of claim 1, further comprising a transducer coupled between the hydraulic cylinder and the controller, the transducer delivering a signal to the controller indicative of the position of the piston.

7. The pressure pulsation dampening system of claim 6, wherein the controller is configured to actuate the valve as a function of the piston position.

8. A reciprocating pump system comprising:

a reciprocating pump with a piston-cylinder assembly, the piston-cylinder assembly operable to pressurize a working fluid and having an outlet; and a pressure pulsation dampening system comprising:

a hydraulic cylinder having a piston movably disposed within a housing and dividing the housing into a working fluid chamber and a hydraulic fluid chamber, wherein the working fluid chamber is in fluid communication with the outlet;

a valve in fluid communication with the hydraulic fluid chamber, the valve actuatable to a first configuration, wherein pressurized hydraulic fluid is supplied to the hydraulic fluid chamber, and to a second configuration, wherein hydraulic fluid is relieved from the hydraulic fluid chamber, and wherein fluid communication between the outlet and the hydraulic fluid chamber is restricted when the valve is in the first configuration and the second configuration; and a control unit configured to actuate the value to the first configuration in response to a pressure decrease at the outlet and to the second configuration in response to a pressure increase at the outlet;

wherein the piston is movable relative to the housing under pressure from working fluid in the working fluid chamber and hydraulic fluid in the hydraulic fluid chamber, whereby working fluid is relieved from the outlet to the working fluid chamber and supplied to the outlet from the working fluid chamber.

9. The reciprocating pump system of claim 8, wherein the pressure of the working fluid at the outlet is a discharge pressure of the piston-cylinder assembly at the outlet, the discharge pressure being adjustable by the flow of working fluid between the outlet and the working fluid chamber.

10. The reciprocating pump system of claim 8, further comprising a transducer coupled between the hydraulic cylinder and the control unit, the transducer delivering a signal to the control unit indicative of the position of the piston.

11. The reciprocating pump system of claim 10, wherein the control unit is configured to actuate the valve as a function of the piston position.

12. The reciprocating pump system of claim 8, further comprising a dampener coupled to the piston, the dampener configured to apply a resistive force that resists movement of the piston when hydraulic fluid is supplied and relieved from the hydraulic fluid chamber.

13. The reciprocating pump system of claim 12, wherein the control unit is configured to control the resistive force applied by the dampener to the piston.

14. The reciprocating pump system of claim 8, wherein the reciprocating pump further comprises a channel in fluid communication with the working fluid chamber and the outlet of the piston-cylinder assembly.

15. The reciprocating pump system of claim 14, wherein the reciprocating pump further comprises an internal throughbore in fluid communication with the outlet and wherein the channel has an internal port that is tangent to a surface bounding the internal throughbore.

16. A method for dampening pressure pulsations in a working fluid discharged by a pump, the method comprising:

disposing a piston within a housing, the piston dividing the housing into a first chamber and a second chamber and being movable relative to the housing;

providing fluid communication between an outlet of the pump and the first chamber;

pressurizing the second chamber with a hydraulic fluid to a predetermined level;

detecting a pressure decrease in the working fluid at the outlet;

increasing the quantity of hydraulic fluid in the second chamber to thereby move the piston to decrease the volume of the first chamber in response to the detected pressure decrease; and increasing the pressure of the working fluid in the first chamber to the predetermined level as a result of the said increasing the quantity of hydraulic fluid in the second chamber.

17. The method of claim 16, further comprising:

detecting a pressure increase at the outlet; and decreasing the quantity of hydraulic fluid in the second chamber to thereby move the piston to increase the volume in the first chamber in response to the detected pressure increase.

18. The method of claim 17, further comprising:

decreasing the pressure of the working fluid in the first chamber to the predetermined level as a result of the said decreasing the quantity of hydraulic fluid in the second chamber.

19. The method of claim 18, wherein the method further comprises resisting movement of the piston when increasing and decreasing the quantity of hydraulic fluid in the second chamber.

* * * * *